United States Patent [19]

Cheng

[11] Patent Number: 4,958,865

[45] Date of Patent: Sep. 25, 1990

[54] CLAMPING SYSTEM

[76] Inventor: Jin J. Cheng, No. 42, Lane 28, Jen Hsing St., San Chong City, Taiwan

[21] Appl. No.: 233,604

[22] Filed: Aug. 18, 1988

[51] Int. Cl.[5] ..... E05C 3/16

[52] U.S. Cl. ..... 292/111; 24/606; 292/113

[58] Field of Search ..... 24/606–608, 24/598, 599, 633; 292/113, 111, 247

[56] References Cited

U.S. PATENT DOCUMENTS

| | | | |
|---|---|---|---|
| 2,820,995 | 1/1958 | Schlueter | 292/111 X |
| 2,853,752 | 9/1958 | Schlueter | 292/111 X |
| 3,295,877 | 1/1967 | Swanson | 292/111 |
| 4,090,727 | 5/1978 | Busch et al. | 292/111 |

*Primary Examiner*—James R. Brittain

*Attorney, Agent, or Firm*—Morton J. Rosenberg; David I. Klein

[57] ABSTRACT

There is disclsed an improved clamping system for releaseably securing two external members (30) and (40) each to the other. The improved clamping system includes a hook member (3) which is fixedly secured to external member (40) and a chassis mechanism (2) which is fixedly secured to external member (30). The chassis mechanism (2) includes a U-shaped supporting frame (21) having a spring (22) passing therethrough. A clamping mechanism (1) is provided which includes a rotative displacement member (12) having an eccentric groove hole (124) formed in a lower disk member (121). A bridge plate member (13) having a central opening (131) encloses and provides a linear restraint for a sliding plate member (14) which includes a slot (141) passing therethrough. An insertion pin (15) passes through the slot (141), the central opening (131) and is insertable within the groove hole (124). Rotation of the rotative displacement member (12) provides for a responsive linear reversible displacement of the sliding plate member (14) for allowing a hooked end (145) to grasp onto the curved end of the hook member (3). In this manner, there is provided an economical, easily manufacturable, one-piece improved clamping system.

4 Claims, 8 Drawing Sheets

CLAMPING SYSTEM

BACKGROUND OF THE INVENTION

FIELD OF THE INVENTION

This invention pertains to clamping structures for releaseably clamping opposing external members. In particular, this invention directs itself to an improved clamping system having a hook member secured to one of the external members to be clamped and a chassis mechanism secured to the other of the external members. A clamping mechanism is provided which is attached to the chassis mechanism and by rotative displacement provides for a linear displacement of a sliding plate member for hooking and capturing the hook member fixedly mounted on the other external member. More in particular, this invention relates to a rotative displacement member which includes an eccentric groove hold within which an insertion pin is provided. Further, this invention directs itself to an improved clamping system where rotative displacement of a disk member responsively linearly actuates a sliding plate member for capturing a hook member on one of the external members to be clamped.

PRIOR ART

Many prior art releaseable clamping systems include a number of parts and elements which make a very complex structure. Such prior art clamping systems include production time costs which are extensive and are complicated to assemble, resulting in a very high cost clamping system. Additionally, in prior art clamping systems the complexity of the combination elements provided for a low reliability of operation and did not provide for economic advantages in use.

SUMMARY OF THE INVENTION

An improved clamping system for releaseably securing two external members each to the other. The improved clamping system includes a hook member which is fixedly secured to one of the external members. A chassis mechanism is fixedly secured to the other of the external members. The chassis member includes a U-shaped supporting frame and a spring member extending through the supporting frame. Of importance, there is provided a clamping mechanism for clamping each of the external members to the other. The clamping mechanism includes a rotative displacement member having a disk shaped lower portion member. The disk member has a horizontal groove formed therein for insertion of opposing ear members of a butterfly shaped operating plate member. An elongated spring member is positionally located within the horizontal groove for providing a biasing force on the opposing ear members for positioning the butterfly operating plate member. The disk member is divided by the groove into a first section having a concavely shaped recess and a second section having a groove opening. The groove opening is located eccentric to a rotational axis of the rotative displacement member. The clamping mechanism further includes a bridge plate member having a central opening and a curved bottom wall for passing over one arm of the chassis spring member. The bridge plate member is in sliding engagement with a sliding plate member having a curved end portion for engaging the hook member and further includes a slot formed through the sliding plate member. The slot as well as the central opening and the groove opening are vertically aligned for insert therethrough of an insertion pin member. The sliding plate member further includes a U-shaped opening defining a spring tongue having a raised portion for removable insert into the concavely shaped recess in the disk member.

DESCRIPTION OF THE PREFERRED EMBODIMENTS

Figure 1:
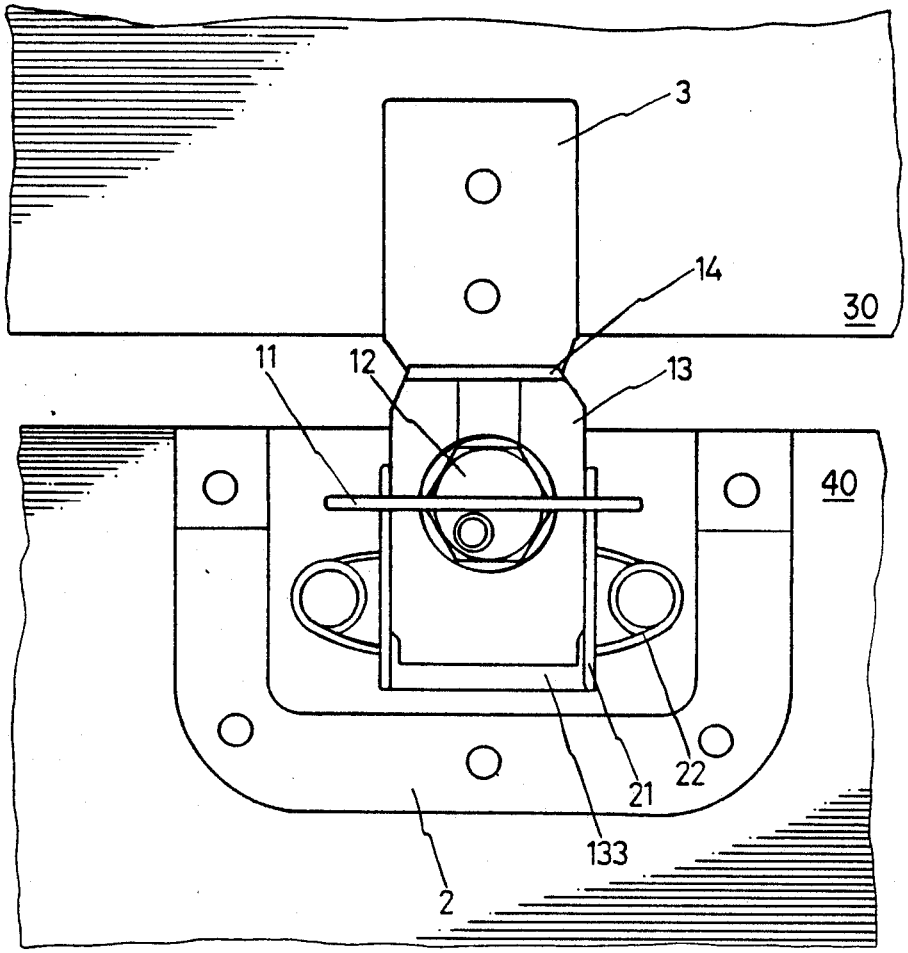
FIG. 1 is a plan view of the improved clamping system showing opposing external members to be clamped.

Referring now to FIGS. 1–7, there is shown an improved clamping system for releaseably coupling external panel members 30, 40 each to the other. External panel members 30 and 40 provide for a substantially planar extension at their upper surfaces as is clearly seen in FIG. 2. Hook member 3 is fixedly secured to external member 40 at an upper surface through threaded securement such as screws, bolt or some like technique not important to the inventive concept as herein described. Hook member 3 includes a hook end section which is releaseably coupled to other elements of the improved clamping system as will be detailed in following paragraphs.

Referring now to FIGS. 2, 7A, 7B and 7C, there is provided a chassis mechanism 2 which is fixedly secured to external member 30. Chassis mechanism 2 includes a U-shaped supporting frame and a flexible spring 22 extending therethrough. Flexible spring 22 generally has coiled opposing ends and two connecting arms, one coupled to the supporting frame 21 and the other coupled to the curved front wall 133 of bridge plate member 13. The chassis mechanism 2 further includes a butterfly operating plate 11 having two connecting operating plate ears 111 which are insertable on opposing ends of horizontal groove 122 formed in disk 121.

Elongated flexible spring 125 is mounted adjacent operating plate ears 111 on a lower surface thereof to provide a biasing force to maintain butterfly operating plate 11 in a substantially biased positional relation with respect to chassis mechanism 12. Basically, spring 125 is compressively mounted on ears 111 as is shown in FIG. 5.

First section 121 includes concavely shaped recess 123 and disk second section includes groove hole 124 which is positioned eccentric to a vertical center line rotation axis of rotative displacement member 12.

Figure 4:
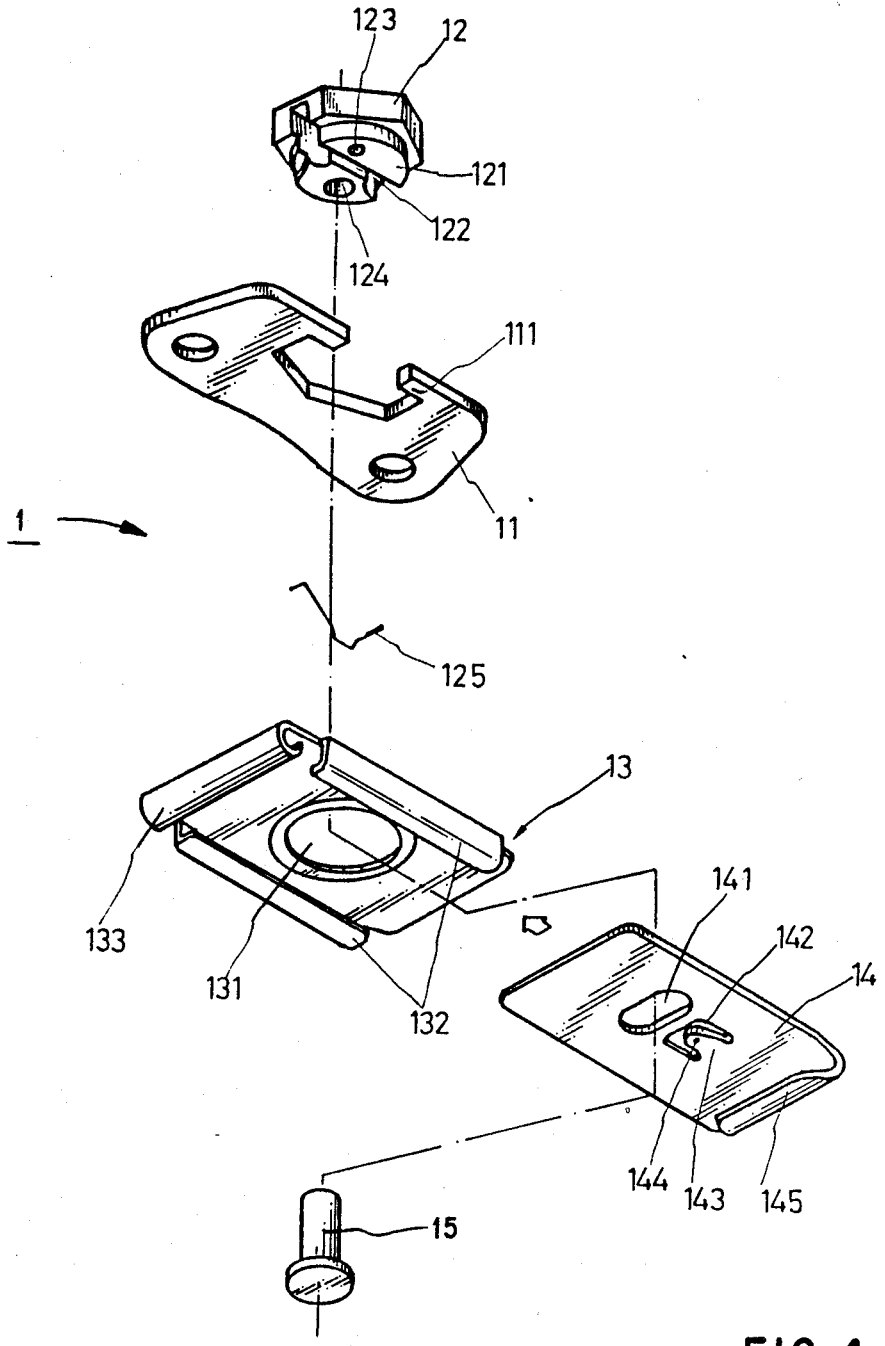
FIG. 4 is a perspective exploded view of the clamping mechanism of the subject invention.

Bridge plate member 13 is generally planar in contour and includes central opening 131 passing therethrough as is shown in FIG. 4. Additionally, bridge plate member 13 includes concavely directed lower walls 132 and frontal curved wall 133. Frontal curved wall 133 is hook shaped and is adapted for passing over and being held by one of the extending legs which bias other elements in the improved clamping system as will be detailed in following paragraphs.

Figure 3:
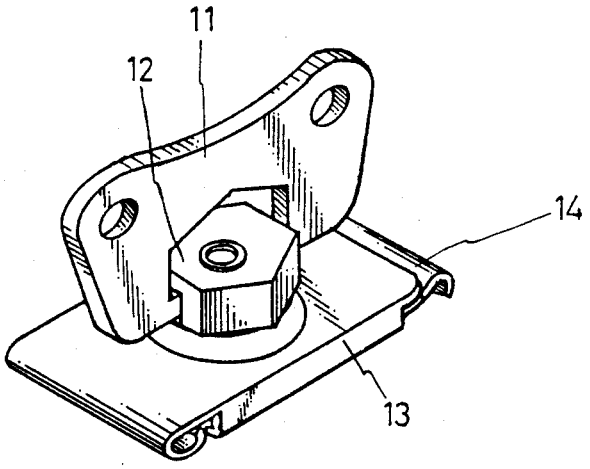
FIG. 3 is a perspective view of the clamping mechanism of the improved clamping system of the subject invention concept.
Figure 5:
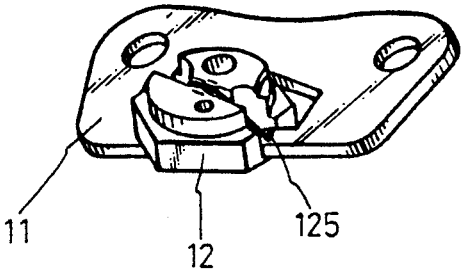
FIG. 5 is a perspective view of the upper portion of the clamping mechanism.

Referring now to FIGS. 3–5, there is shown clamping mechanism 1 for releaseably clamping each of external members 30, 40 to the other. Clamping mechanism 1 includes rotative displacement member 12 which is rotatable about a vertical axis line. Rotative displacement member 12 generally includes an upper polygonal shaped disk and a lower disk 121 which generally is circular in contour as is seen in FIG. 4 and has a diameter less than an external perimeter diameter of the upper portion of rotative displacement member 12.

Figure 2:
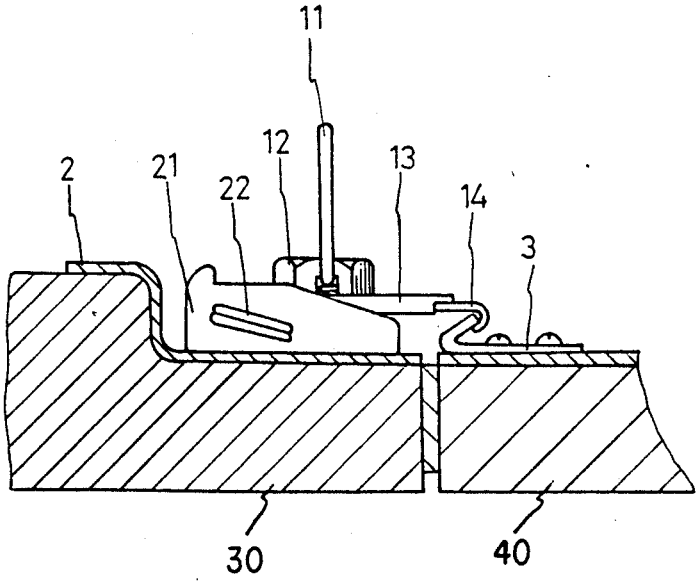
FIG. 2 is an elevation view of the improved clamping system shown mounted in a clamped condition on opposing external members.

Disk 121 includes horizontal groove 122 formed in a diameter line therethrough. In this manner, disk 121 is divided into a first and second section having cross-sections in the contour of a semi-circle. Horizontal groove 122 passes through disk 121 and is adapted for insertion of a butterfly arms 111 insertable into groove 122. The supporting frame 21 and the bridge plate member 13, coupled to respective shaped operating plate 11. Butterfly operating plate 11 includes butterfly arms of spring member 22, are mounted on cassis mechanism 2. Thus, linear displacement of bridge plate member 13 causes a pulling on one of the arms of spring 22 and provides a biasing retarding displacement force. As has been described, spring 22 is mounted to chassis 2 and the associated U-frame supporting member 21 as is shown in FIG. 2.

Sliding plate member 14 is generally planar in contour and includes horizontal slot 141 formed therethrough. Insertion pin member 15 passes through slot 141, central opening 131, and then into groove hole 124 of rotative displacement member 12.

Sliding plate member 14 is insertable between concave walls 132 of bridge plate member 13 and is slidable in a reversible linear direction as can be seen in FIGS. 4 and 7. Sliding plate member 14 includes frontal hook member 145 which is adapted to interface and be captured by the frontal curved section of hook member 3 as is shown in FIG. 2.

Sliding plate member 14 further includes U-shaped groove 142 passing therethrough as is shown in FIG. 4. Extending through the center is spring tongue 143 having a raised portion member 144 which is adapted for insert into concavely contoured recess 123 of rotative displacement member 12.

Figure 7A:
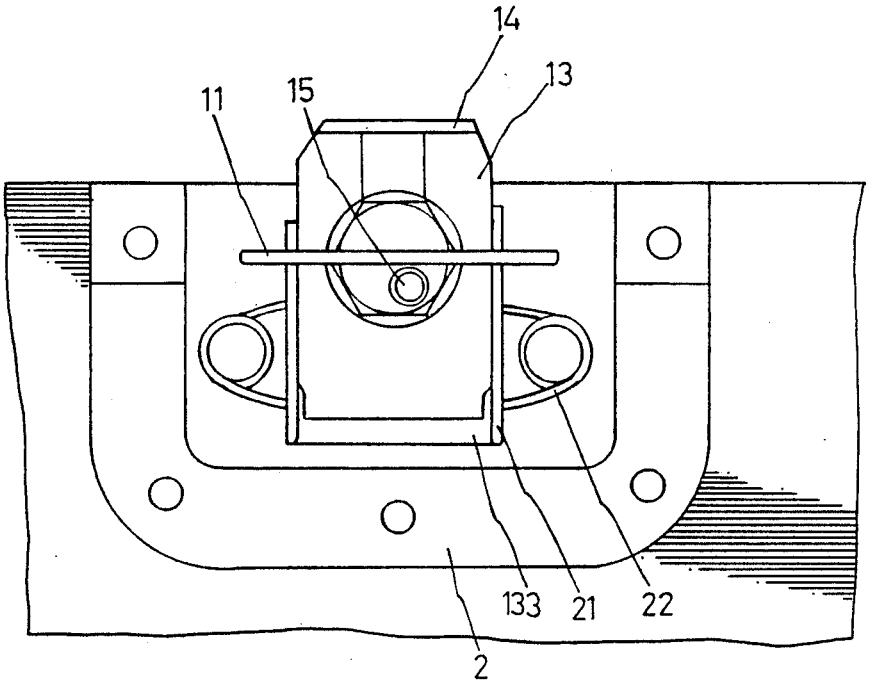
Figure 7B:
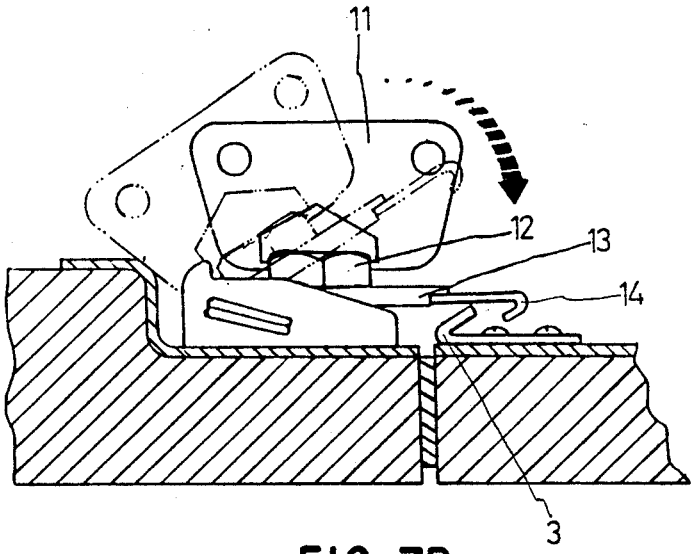
Figure 7C:
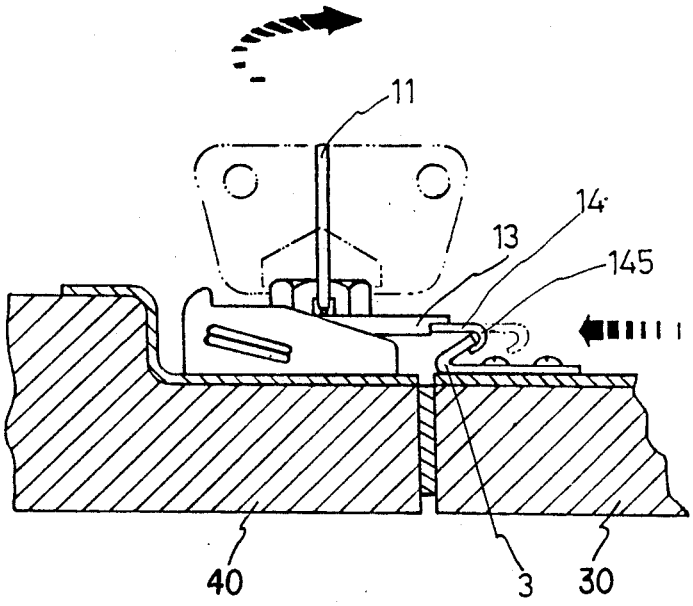

Referring now to FIGS. 7A, 7B and 7C, there is shown the operation of the improved clamping system. Since curved end 133 passes around in loose fashion one of the arms of flexible spring 22, the mechanism 1 may be rotated to the phantom line drawing configuration shown in FIG. 7B. In this configuration, sliding plate member 14 and the associated hook member 145 are not in contact with the hook portion of hook member 3. As shown in FIG. 7C, butterfly operating plate 11 is rotated which causes insertion pin 15 to be linearly displaced due to the fact that insertion pin 15 passes through slot 141 and causes a linear displacement of sliding plate member 14. In this manner, angled end 145 hooks into the curved end of hook member 3 to provide a releaseable coupling between the external members 30 and 40.

Figure 6A:
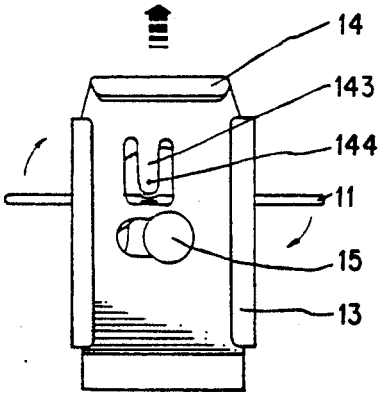
FIG. 6*a* and 6*b* bottom are views of the clamping mechanism showing two opposing conditions of the sliding plate member; and, FIG. *7A–C* show operational elevational views of the improved clamping system between an unclamped and a clamped condition.
Figure 6B:
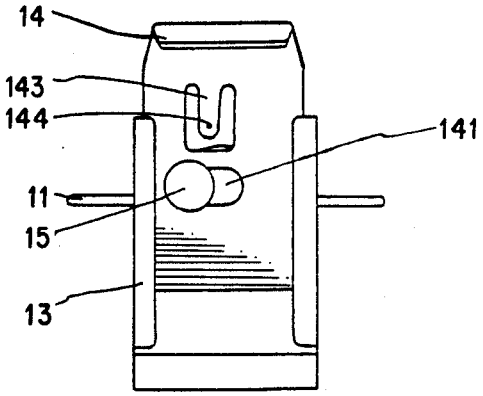

Other operational aspects are shown in FIG. 6. In a non-clamped condition, sliding plate member 14 is displaced internal to bridge plate member 13 between concave walls 132. Raised or convex portion 144 of spring tongue 143 snaps into concave recess 123 on rotative displacement member 12.

When butterfly operating plate member 111 is rotated about a vertical axis, raised portion 144 on spring tongue 143 exits from a concave recess 123 on rotative displacement member 12. Eccentric groove hole 124 moves or displaces insertion pin 15 on sliding plate member 14. The eccentric displacement is provided as operating plate 11 revolves about 180° with a responsive degree change for rotative displacement member 12.

In this manner, a simple rotative displacement results in a linear reversible displacement of related elements in the improved clamping system as herein detailed.

What is claim is:

1. An improved clamping system for releaseably securing two external members each to the other, comprising:

(a) a hook member fixedly secured to one of said external members;

(b) chassis means fixedly secured to the other of said external members, said chasis means including a U-shaped supporting frame and a spring member extending through said supporting frame;

(c) means for clamping each of said external members to the other, said clamping means including a rotative displacement member having a disk shaped lower portion member, said disk member having a downwardly open horizontal groove formed therein for insertion of opposing ear members of a butterfly shaped operating plate member, an elongated spring member is positionally located substantially entirely within said horizontal groove and being compressively mounted on said opposing ear members for providing a biasing foce on said opposing ear members for positioning said butterfly operating plate member, said disk member being divided by said groove into a first section having a concavely shaped recess and a second section having an opening formed therethrough, said opening formed in said second section being located eccentric to a rotational axis of said rotative displacement member, said clamping means further including a bridge plate member having a central opening and a curved bottom wall for passing over one arm of said chassis spring member, said bridge plate member being in sliding engagement with a sliding plate member having a curved end portion for engaging said hook member and a slot formed through said sliding plate member, said slot, central opening, and opening formed in said second section of said disk member being vertically aligned for insert therethrough of an insertion pin member, said sliding plate member further including a U-shaped opening defining a spring tongue having a raised portion for removable insert into said concavely shaped recess in said disk member.

2. The improved clamping system as recited in claim 1 where rotation of said rotative displacement member provides a responsive linear displacement of said sliding plate member.

3. The improved clamping system as recited in claim 2 where said clamping means is rotatively displaceable in a plane substantially normal to a plane defining said hook member and chassis means mounting surfaces.

4. The improved clamping system as recited in claim 1 where said clamping means is formed as an integral structure.

* * * * *